United States Patent [19]

McCabe

[11] 4,170,390

[45] Oct. 9, 1979

[54] PAPER TOWEL DISPENSER

[76] Inventor: Stanley G. McCabe, 4602 50th, #156, Lubbock, Tex. 79414

[21] Appl. No.: 884,901

[22] Filed: Mar. 9, 1978

[51] Int. Cl.[2] ..... B65H 19/00

[52] U.S. Cl. ..... 312/37; 312/38; 312/39; 242/55.53

[58] Field of Search ..... 312/38, 37, 39, 41; 242/55.3, 55.53

[56] References Cited

U.S. PATENT DOCUMENTS

| | | | |
|---|---|---|---|
| 1,410,068 | 3/1922 | Marshall et al. | 312/38 |
| 1,756,822 | 4/1930 | Hails | 312/38 |
| 1,756,839 | 4/1930 | Steiner et al. | 312/38 |
| 1,788,962 | 1/1931 | Steiner | 312/38 |
| 1,916,542 | 7/1933 | Trewhitt et al. | 312/38 |
| 2,295,955 | 9/1942 | La Page | 312/38 |
| 2,930,663 | 3/1960 | Weiss | 312/38 |
| 3,574,431 | 4/1971 | Henderson | 312/38 |
| 3,858,951 | 1/1975 | Rasmussen | 312/38 |
| 3,858,952 | 1/1975 | Bahnsen | 312/38 |

*Primary Examiner*—Victor N. Sakran

*Attorney, Agent, or Firm*—Hill, Van Santen, Steadman, Chiara & Simpson

[57] ABSTRACT

The apparatus disclosed is for a dispenser for nylon reinforced paper toweling drawn from a roll of paper in a cabinet and returned to drop to the bottom of the cabinet when used. The roll of paper is floatingly supported in the cabinet for unrolling. Towel supply means accommodate the towel to be drawn through a dispensing opening. The roll is completely isolated from the used or spent toweling, which is passed through a slot into the cabinet and returned by towel return means. The top of the cabinet is hinged downwardly along the front of the cabinet to enable a clean roll to be placed in position in the cabinet. The spent toweling returned to the cabinet may be compacted in the bottom of the cabinet by a compactor in the cabinet and manually operated from outside of the cabinet. A slidable bottom plate forms the bottom of the cabinet, to accommodate removal of the compacted spent or dirty paper toweling.

12 Claims, 13 Drawing Figures

PAPER TOWEL DISPENSER

BACKGROUND, SUMMARY AND ADVANTAGES OF INVENTION

Cloth towel dispensers in which clean toweling is drawn from a roll in a cabinet are common. With such dispensers, the dirty toweling is rolled up in the cabinet between the pressure nips of a pair of rolls operated by withdrawal of the clean toweling, in direct contact with one of the rolls through which the clean toweling passes. This transfers some of the moisture and dirt from the dirty toweling to the clean toweling, rendering the dispenser unsanitary and likely to transfer skin and other diseases to the person using the towel to dry his hands or face.

By the apparatus of the present invention, I utilize a reinforced nylon paper towel rolled on a hollow core which may be cardboard, and separate a clean towel compartment in which the nylon paper roll is contained from a spent towel compartment by a partition forming the bottom of the clean towel compartment. I draw the clean paper toweling in cooperation with towel supply means out of the cabinet through a dispensing opening. The dirty or spent towel enters the cabinet and is drawn thereinto through a slot in cooperation with said towel return means driven from the towel supply means. The damp, dirty toweling may be compacted in the bottom of the cabinet by a compactor operable from the outside of the cabinet and compacting the loose toweling into a slidable bottom plate to enable the spent toweling to be readily removed.

A principal advantage of the present invention is that clean reinforced paper toweling may be withdrawn from the cabinet and the spent toweling may be returned to the bottom of the cabinet and completely isolated from the clean toweling as drawn into the cabinet.

Another advantage is that rolled nylon reinforced paper toweling, which is difficult to tear, may be used and withdrawn from the clean towel compartment from above or beneath the compartment and returned to a spent towel compartment in the cabinet, and where it is desired to tear the clean toweling for use for cleaning purposes, away from the cabinet, a separate piece may be torn and used and the free end of the toweling may then be placed through a slot to the towel return means and returned to a spent towel compartment as the clean toweling is withdrawn.

Still another advantage of the invention is that ready access may be had to the towel supply means, the support for the roll of paper toweling and the towel return and supply means for removal as a unit.

Another advantage is in the ease of placing a clean roll of paper toweling in the clean towel compartment in the cabinet, and in the compactor, compacting dirty toweling into the bottom of the cabinet to be withdrawn in a compacted form.

Other objects, features and advantages of the invention will be readily apparent from the following description of certain preferred embodiments thereof, taken in conjunction with the accompanying drawings, although other variations and modifications may be effected without departing from the spirit and scope of the novel concepts of the disclosure.

DESCRIPTION OF PREFERRED EMMBODIMENTS

Figure 1:
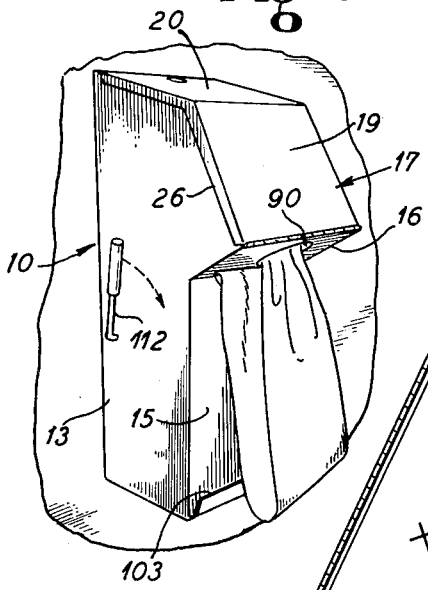
FIG. 1 is a generally perspective view of a paper towel dispenser constructed in accordance with the principles of the present invention and illustrating one form in which the invention may be embodied.
Figure 2:
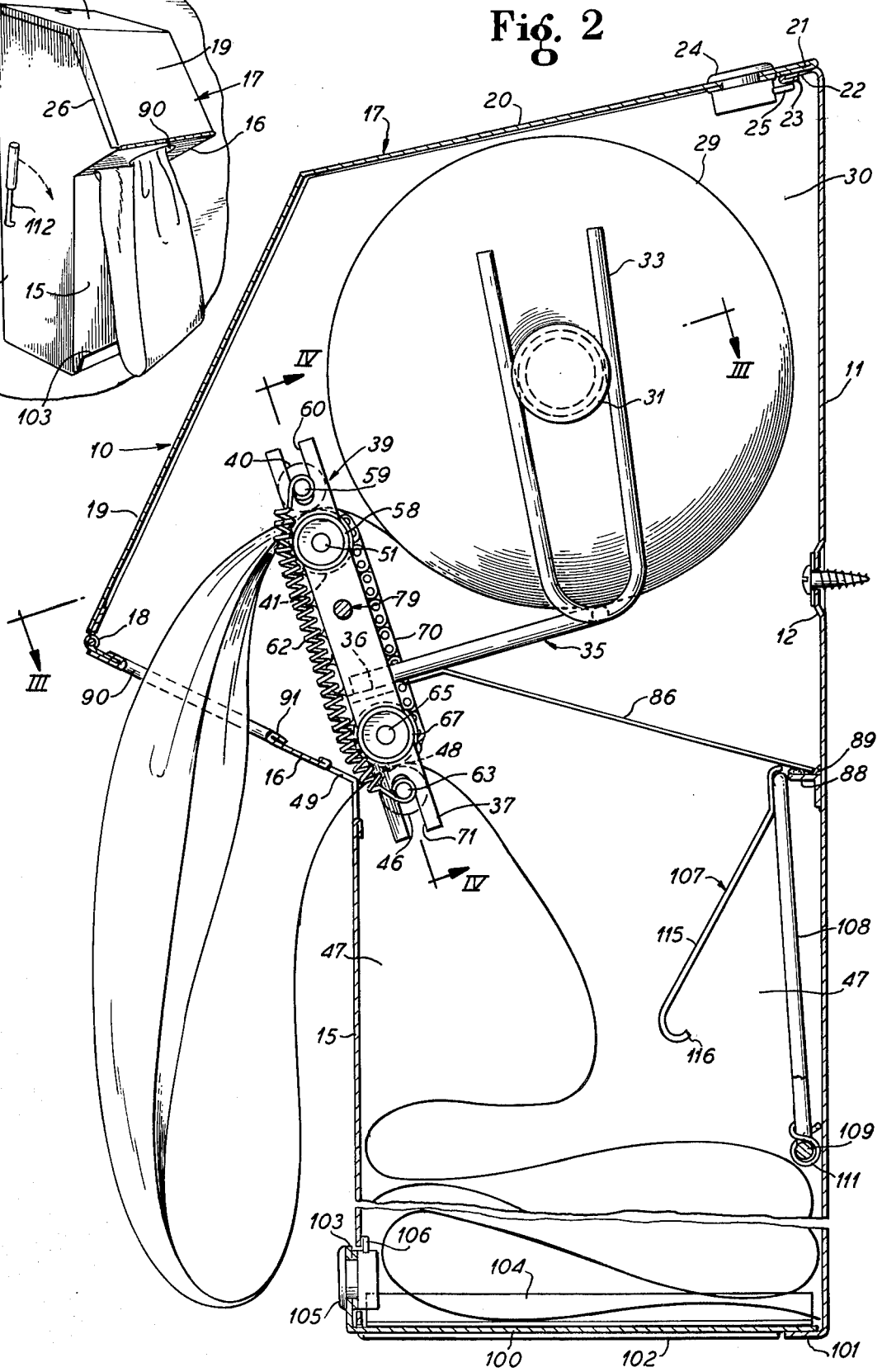
FIG. 2 is a transverse sectional view of the dispenser shown in FIG. 1.

In the embodiment of the invention illustrated in FIG. 1 of the drawings, I have shown a dispenser 10 adapted for reinforced paper toweling of various types and particularly nylon reinforced paper toweling of a type known to the art. The cabinet 10 is shown in FIGS. 1 and 2 as having a rear wall 11, which may have inward embossments 12 extending into the cabinet and drilled to accommodate screws or other securing means to pass therethrough for securing the cabinet to a wall or the like.

The cabinet also has parallel side walls 13 and a front wall 15 extending for a portion of the height thereof and terminating into an angular upwardly and outwardly extending plate 16 extending between the side walls 13 and welded or otherwise secured thereto. A cover 17 is shown as being hinged to the outer end of the plate 16 by a hinge 18. Said cover has a portion 19 extending angularly upwardly and inwardly of the plate 16 and has a top portion 20 extending to the rear wall 11 and having an in-turned end portion 21 to give the cover rigidity and resting on a lip 22 extending inwardly of the top of the rear wall 11. The lip 22 has an in-turned end portion 23 to lend rigidity to the lip. A latch 24, which may be a well-known form of key-operated latch, is mounted in the plate 16 in a conventional manner and has a latch bolt 25 extending along the lip 22, when said latch is in the locked position, to lock the cover 17 closed. The cover also has flanges 26 extending along the outsides of the side walls 13 to not only reinforce the cover, but also to prevent dirt from entering the cabinet.

Figure 8:
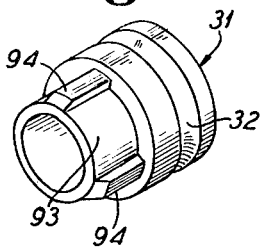
FIG. 8 is a detail perspective view showing certain details of a plug floatingly supporting an end of the roll of paper and rotatable therewith.
Figure 7:
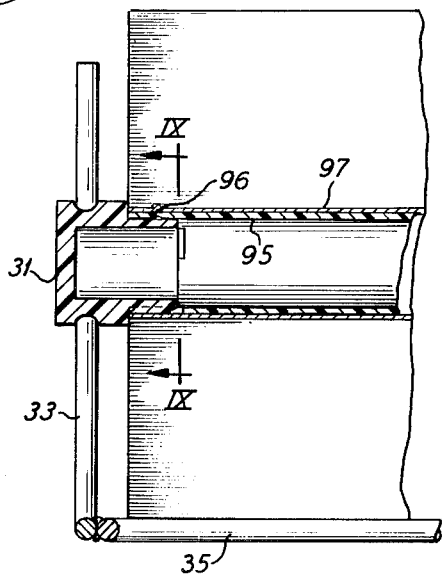
FIG. 7 is a partial fragmentary sectional view taken substantially along line VII—VII of FIG. 6.

A roll of paper toweling 29 is rotatably supported at the upper end of the cabinet in a clean towel compartment 30 on plugs 31. Said plugs are shown in detail in FIG. 8 and each has a grooved portion 32, the grooves of which fit in upwardly opening yokes 33. The yokes 33 may be made from rod and are shown as being U-shaped in formation and connected together by a U-shaped bracket 35 at the base thereof.

Figure 6:
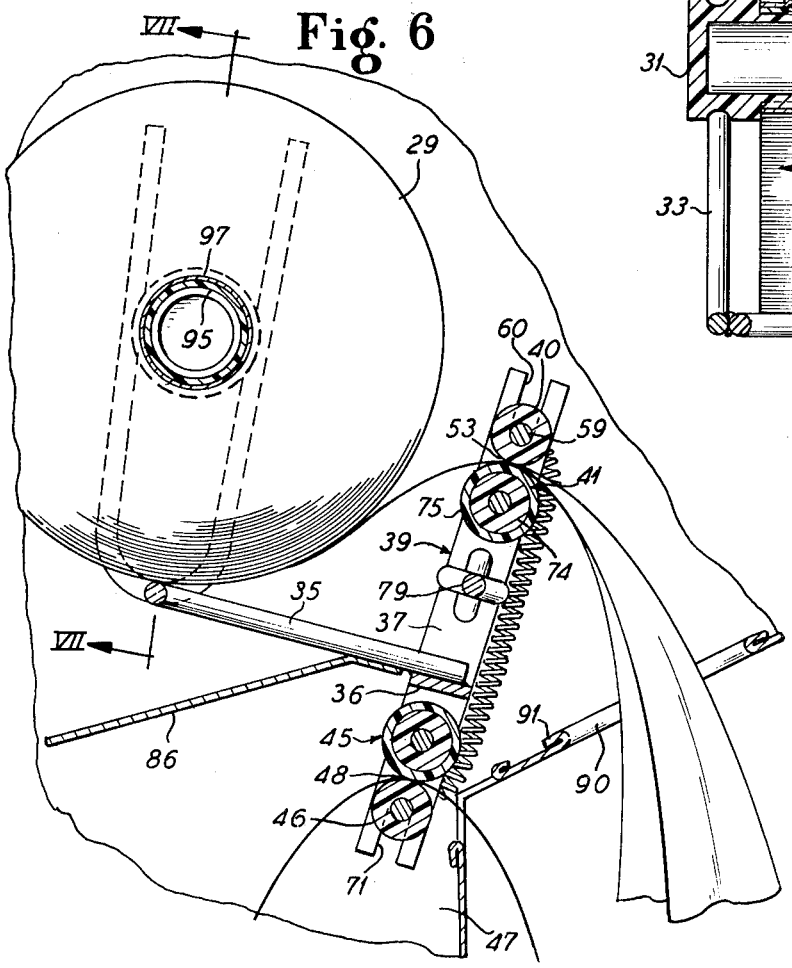
FIG. 6 is a partial fragmentary sectional view similar to FIG. 5, but showing certain details not shown in FIG. 5 and showing the towel supply and return means in section.
Figure 9:
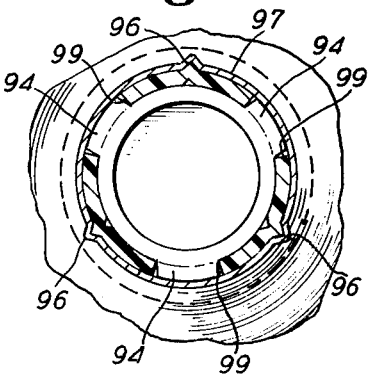
FIG. 9 is a fragmentary sectional view taken subtantially along line IX—IX of FIG. 7.
Figure 10:
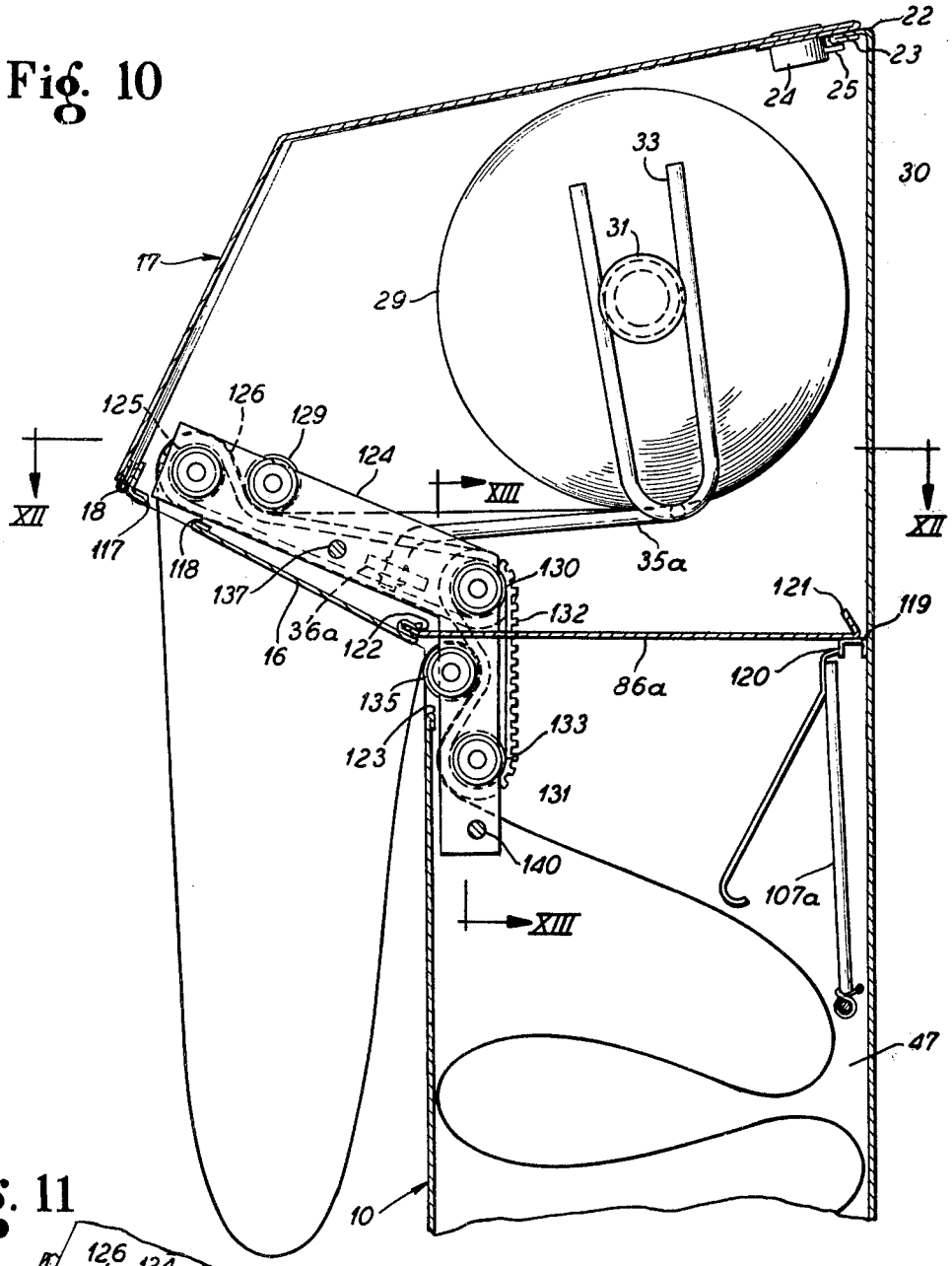
FIG. 10 is a transverse sectional view somewhat similar to FIG. 2, but illustrating a modified form of the invention.

The bracket 35 is also of a generally U-shaped formation and may be made of rod and is welded or otherwise secured to the bases of said yokes, to limit downward movement of the roll of paper. The legs of the bracket 35 are shown in FIG. 6 as resting on a cross ledge 36 and as being welded or otherwise secured thereto.

The cross ledge 36 extends between a pair of parallel spaced plates 37 of a bracket 39, supporting an upper pair of pinch rolls 40 and 41 in the clean towel compartment 30 and a lower pair of pinch rolls 45 and 46 in a spent towel compartment 47. Said pinch rolls 45 and 46 have a pressure nip 48 in alignment with a slot 49 accommodating the used paper toweling to be fed into the spent towel compartment 47.

Figure 4:
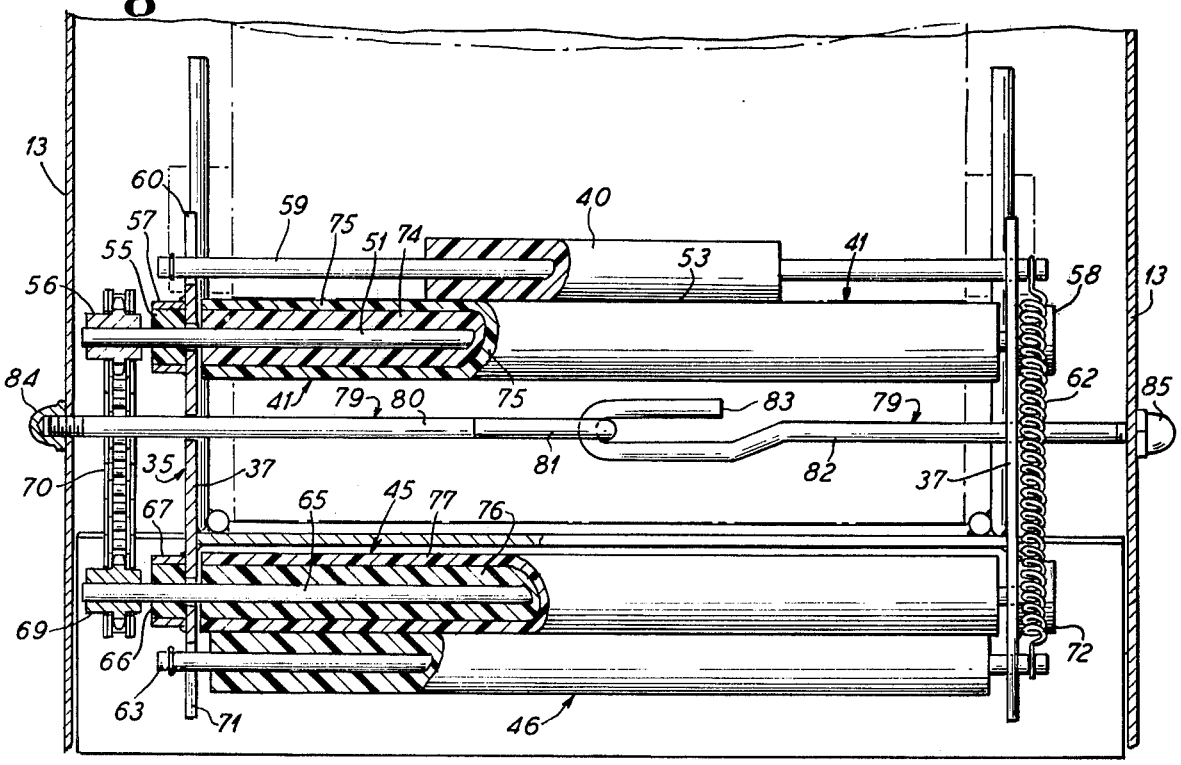
FIG. 4 is a sectional view taken substantially along line IV—IV of FIG. 2 and illustrating the towel supply and return means and the drive thereto.
Figure 5:
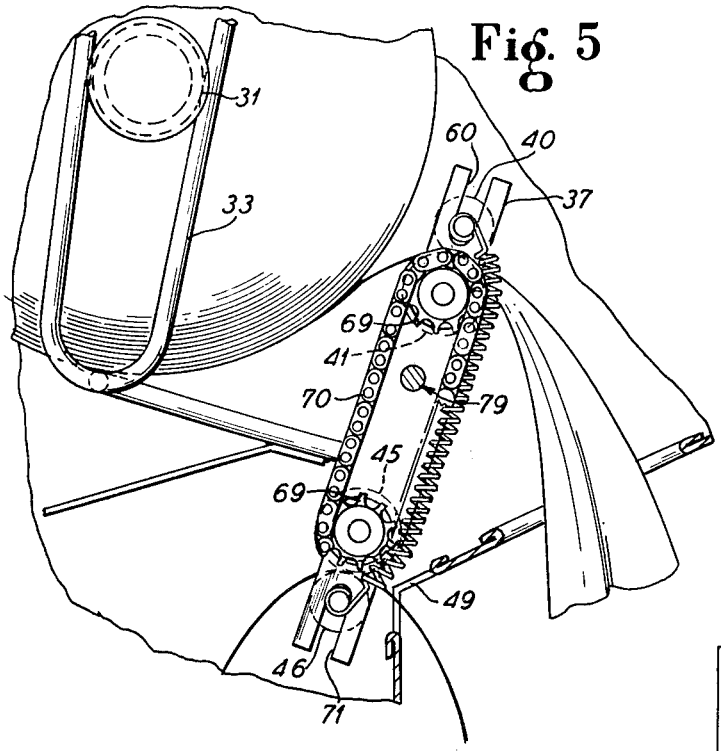
FIG. 5 is a partial fragmentary longitudinal sectional view illustrating the support for the roll of paper toweling and the dispensing opening in section.

As shown in FIG. 4, the pinch roll 41 is mounted on a shaft 51 to rotate said shaft by the pressure created by a pressure nip 53 between the upper pinch roll 40 and the pinch roll 41, when it engages the paper as drawn from the cabinet from the roll 29, and is shown in FIG. 4 as being rotatably journalled in a bearing 55 at one end and as extending beyond said bearing and having a sprocket 56 keyed or otherwise secured thereto to be driven by the shaft 51 upon rotation of the pinch roll 41.

The bearing 55 may be a well-known form of plastic bearing encased in a collar 57 extending outwardly of the plate 37 of the bracket 35. The opposite end of the shaft 51 extends through a similar bearing carried in a collar 58 extending from the opposite plate 37 of the bracket 35.

The uppermost pinch roll 40, defining the pressure nip with the pinch roll 41, is mounted on a shaft 59 slidably carried at its ends in slots 60 opening to the tops of the plates 37. The shaft 59 has tension springs 62 connected between opposite ends of said shaft and opposite ends of the shaft 63 for the lowermost pinch roll 46 to bias said pinch rolls 41 and 46 into engagement with the drive and driven rolls 41 and 45 to thereby provide pressure nips between said rolls, and to drive the respective rolls 41 and 45 to draw dirty or damp paper toweling into the cabinet into a spent towel compartment in the cabinet as clean paper toweling is drawn from the cabinet between the pinch rolls 40 and 41.

The upper pinch roll 45 of the pinch rolls 45 and 46, like the pinch roll 41, is mounted on a shaft 65. One end of said shaft extends through a bearing 66 which may be like the bearing 55 and is carried in a collar 67. The shaft 65 projects beyond the end of the collar 67 and has a sprocket 69 keyed or otherwise secured thereto and driven by the sprocket 56 through a drive chain 70.

While I have herein shown a flexible drive connection between the shafts 51 and 65 as being in the form of a chain and sprocket drive, the drive connection need not necessarily be a chain and sprocket drive, but may be a V-belt drive and particularly a toothed-typed of V-belt drive to drive the shaft 65 from the shaft 51 at the same rate of speed as the shaft 51, or may be any other form of simplified form of drive.

As is evident from FIGS. 4 and 6, the shaft 63 is slidably mounted at its lower ends in slots 71 in the plates 37 of the bracket 35 to accommodate the springs 62 to provide pressure nips between the upper set of pinch rolls 40 and 41 and the lower set of pinch rolls 45 and 46. The springs 62 are herein shown as being coiled types of springs and as passing along the outside of the collars 57 and 67 extending from one side of the bracket 35, and collars 58 and 72 extending from the opposite plate 37 of the bracket 35, and welded or otherwise secured to said plate. Each of said collars encases a suitable bearing to accommodate free rotation of the shafts 51 and 65.

The roll 41 is shown in FIGS. 4 and 6 as having a relatively hard plastic interior 74 having a softer sleeve 75 extending thereabout. In a similar manner, the roll 45 has a relatively hard plastic interior 76 having a softer sleeve 77 extending thereabout.

The interiors 74 and 76 of the respective rolls 41 and 46 may be of a nylon plastic material, although they need not necessarily be of such a material. The softer sleeves 75 and 77 may be of a softer vinyl to provide yieldability for the respective pressure-exerting rolls 40 and 46. The pressure exerting rolls 40 and 46 may each be of a nylon plastic material providing relatively hard exterior gripping surfaces, although they need not necessarily be nylon, but may be made from various other materials providing substantially the same qualities as nylon rolls.

The side walls 13 may be connected together and the roll assemblies may be removably retained in the cabinet by a tie rod 79, herein shown as being in two parts and extending through the side plates 37 of the bracket 35 and the runs of the drive chain 70 (FIG. 4). One part 80 of the tie rod 79 has an eye 81 formed on the end thereof while another part 82 of said tie rod has a generally hooked portion 83 engaging the eye 81. Nuts 84 and 85 are threaded on opposite ends of the tie rod 79 and may be tightened to bring said tie rod under tension and retain the bracket 35 to the cabinet and to accommodate ready removal of said bracket with the pinch roll assembly and yokes 33 for maintenance. The tie rod 79 also maintains the side walls in engagement with an isolating plate 86 isolating the clean towel compartment 30 from the spent towel compartment 47.

The isolating plate 86 is shown as abutting the underside of the bracket 35 and as being welded or otherwise secured to the legs thereof. Said isolating plate 86 extends angularly downwardly from said bracket over a generally horizontal lip 88 extending across and inwardly of the inside of the rear wall 11. Said isolating plate 86 may rest upon a suitable seal 89 extending along the top of the lip 88 to increase the isolating qualities of said plate. The forward end portion of the roll assembly may be supported in position in the cabinet about the tie rod 79 by the springs 62, resting within the cabinet at the juncture between the walls 15 and 16 outwardly of the slot 49, as shown in FIG. 2.

Access may, therefore, be had to the roll assembly through the cover 17 when downwardly hinged, and the entire roll assembly may readily be removed upon removing the nuts 84 from the ends of the tie rod 79 and pushing said tie rod inwardly of the side walls of the cabinet 10.

Figure 3:
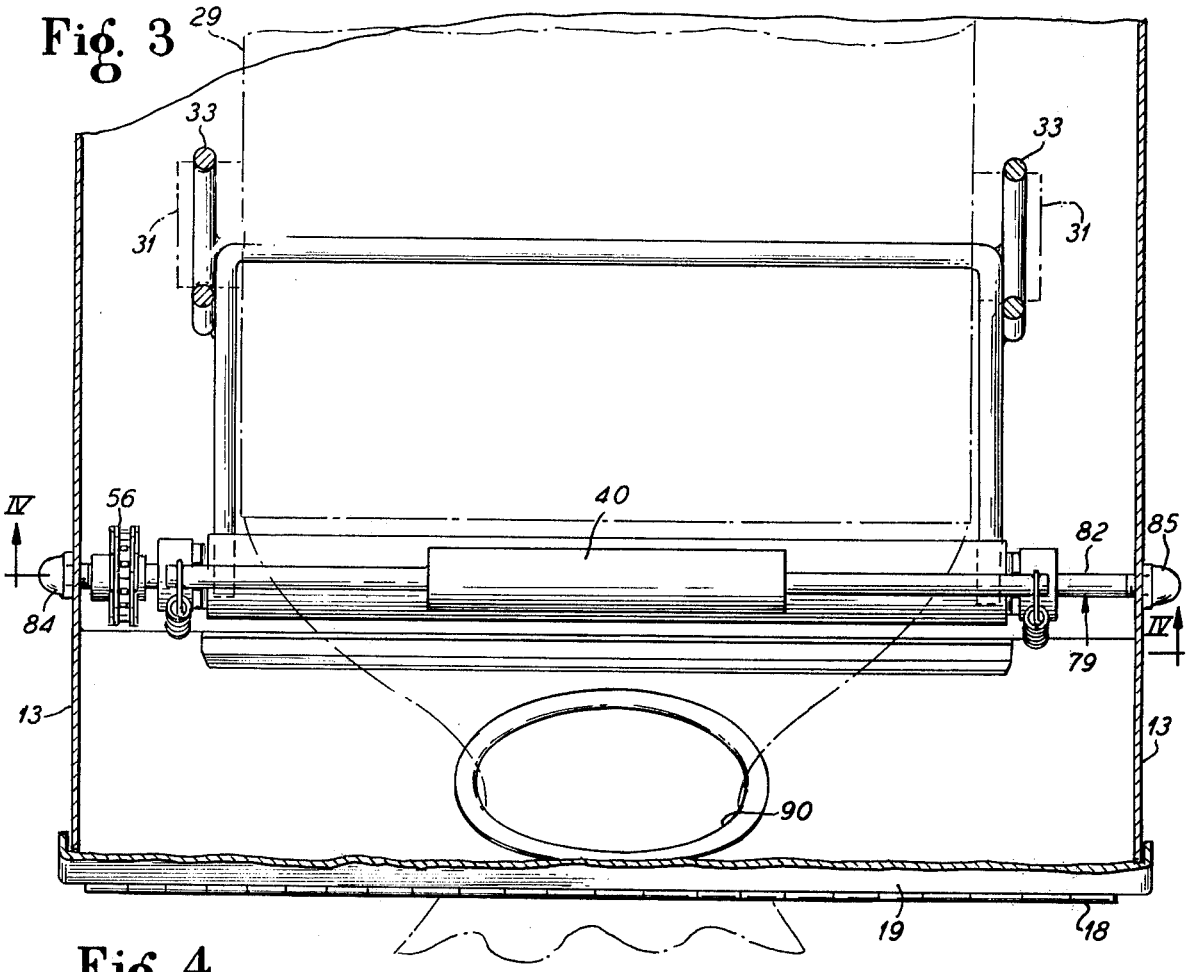
FIG. 3 is a partial fragmentary transverse sectional view looking substantially along line III—III of FIG. 2.

As shown in FIGS. 3 and 4, the pressure roll 40 is shorter than the roll 41 with which it has pressure nip engagement, but the transverse center of said pressure roll is in alignment with the transverse center of the pressure roll 41. This enables the paper toweling, as drawn through a clean towel dispensing opening 90 in the plate 16, to be restricted in width, as drawn through said opening for a purpose which will now be described.

The dispensing opening 90 is shown in FIGS. 1 and 3 as being a generally circular opening, although it need not necessarily be circular, but may be elliptical or even an elongated rectangle, but should not be as long as the width of the paper toweling and the edges of the opening should be smooth, with no corners. Said dispensing opening 90 is shown as having an in-turned lip 91 providing a smooth surface through which the towel is drawn as restricted, and to thereby prevent tearing of the towel. The purpose of the restricted opening is to permit withdrawal of the clean towel from beneath the opening 90 by a short person, from above the opening 90 by a relatively tall person, or from either side of said opening, to thereby make it unnecessary to withdraw the toweling from the clean towel compartment from a set location relative to said dispensing opening 90.

The short pressure roll 40, being shorter than the width of the roll of paper toweling, accommodates the paper toweling to be restricted in width as passing through the dispensing opening 90 and to then expand in width as passed through said opening and used to dry the hands or face.

Referring now in particular to the mounting of the roll of clean toweling 29 between the yokes 33 on the plugs 31, and to freely rotate said plugs in the yokes 33 as withdrawn, each plug 31 has a reduced diameter interior portion 93 having keys 94 extending radially therefrom. The reduced diameter portion 93 of each plug 31 is adapted to fit within a plastic sleeve 95 extending for the length of the roll and to have a relatively right fit with the interior portion of said plastic sleeve, to force embossments 96 extending outwardly of said sleeve into engagement with a paperboard core 97 for the roll of paper toweling. The keys 94 engage slots or keyways 99 formed in the ends of the sleeve 95 to rotatably drive said plugs as the paper toweling is withdrawn through the pressure nip 53 between the pinch rolls 40 and 41 and to thereby give sufficient stability to the roll of paper toweling to enable the toweling to readily be restricted to pass through the restricted dispensing opening 90.

The cabinet 10 also has a slidable bottom plate 100 (FIG. 2) slidably resting on in-turned flanges 101 and 102, extending inwardly of the respective side walls 11 and 13 of the cabinet and suitably retained from movement relative to said side walls as by the horizontal flanges of angle irons 104 extending from the side walls 11 and 13 along the top of the bottom plate 100. Said plate 100 has a vertical flange 103 extending upwardly along the outside of the front wall 15. A suitable latch 105 is mounted in said flange 103. Said latch may be key-operated to move a latch bolt 106 into engagement with the inside of the front wall 15, and to thereby lock said plate in position to close the bottom of the cabinet, or to enable said bottom to be opened to enable the compacted spent toweling to be removed from the bottom of the cabinet 10.

A compactor 107 is provided to compact the spent paper toweling, which may be damp, in the bottom of the cabinet. Said compactor is shown in FIG. 2 as including a lever arm 108 pivoted close to the bottom of the cabinet adjacent the rear wall 11 on a pivot pin 109. A torsion spring 111 extends about said pivot pin and biases said lever arm into engagement with the lip 88. The pivot pin 109 extends to the outside of the side walls 13 and has a lever arm 112 extending radially upwardly of an outer end thereof, for pivoting the lever arm 112 in a compacting direction and to accommodate controlled movement of said lever arm 112 in a return direction. Torsion springs 111 may be provided at each side of said lever arm, even though one spring only is shown herein.

The lever arm 108 has a flexible compacting arm 115 extending thereacross and suitably secured thereto at its upper end. Said compacting arm 115 extends angularly outwardly and downwardly of the lever arm 108 and has an in-turned lower end 116 spaced outwardly of said lever arm above the lower end of said lever arm.

Upon downward movement of the lever arm 108 and flexible compacting arm 115, the end 116 of said compacting arm will engage the spent toweling, loose in the cabinet, and flex and tend to move the toweling toward the back of the cabinet, where it may readily be removed upon opening of the bottom plate 100.

In the form of the invention illustrated in FIGS. 10 through 13, the cabinet for the clean and spent toweling is generally similar to the cabinet shown in FIGS. 1 through 9, so need not be described in detail, except to point out that an elongated dispensing opening 117 is provided in the outwardly extending plate 16, adjacent the hinge 18 for the cover 17. Like part numbers will therefore be applied to like parts in FIGS. 10 to 13 as were applied to FIGS. 1 to 9 inclusive.

The dispensing opening 117 may be slightly wider than the width of the paper toweling and may be generally rectangular in form, having in-turned edges 118 to provide a smooth opening for the toweling. The cover 17 is locked in a closed position by a latch 24 and latch bolt 25 engaging under an in-turned end portion 23 of the lip 22 of the rear wall 11.

An isolating plate **86*a* rests on a web 119 of a channel 120 extending across the rear wall 11, and has an upturned lip 121 affording a means to grip said isolating plate by the fingers and insert or remove said isolating plate within or from a slot 122 extending across the plate 16 adjacent but above a return slot 123, for isolating the used toweling as returned to the spent towel compartment 47** of the cabinet.

Figure 11:
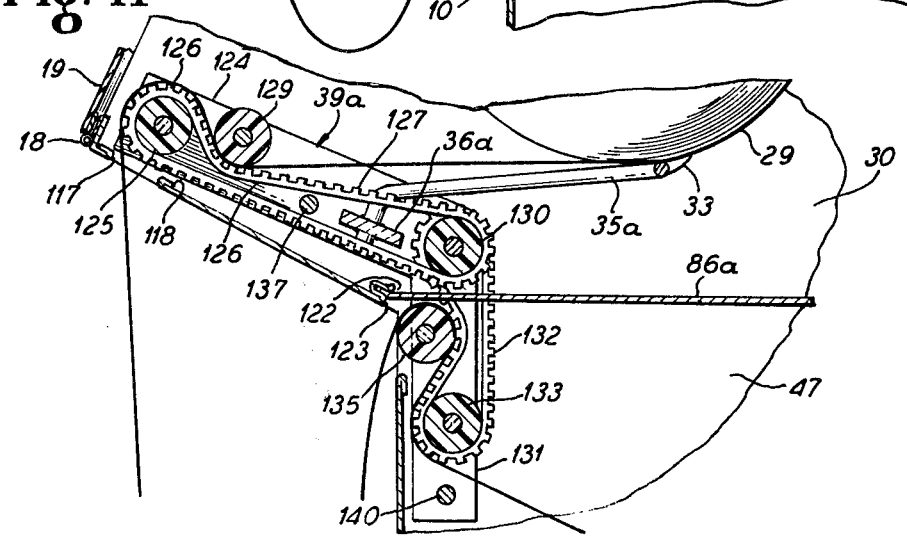
FIG. 11 is a sectional view taken substantially along line XI—XI of FIG. 10 and illustrating the towel supply and return means of FIG. 10.

A compactor **107*a*, like the compactor 107, is provided to compact the spent paper toweling in the bottom of the cabinet. Said compactor may be operated by a hand lever 113 on the outside of the cabinet (FIG. 11**).

The roll of paper toweling 29 is supported in the clean towel compartment 30 on plugs 31 in the same manner as the embodiment of the invention illustrated in FIG. 2. The plugs 31 fit in upwardly opening yokes 33 for rotation with the roll of paper. The yokes 33 extend upwardly of a generally U-shaped bracket **35*a*, which limits downward movement of the roll of paper and has parallel legs suitably secured to a cross bar welded or otherwise secured to a cross plate 36*a* extending across an angle bracket 39*a***.

Arms 124 of the angle bracket **39*a* are parallel and extend along the plate 16 in spaced relation with respect thereto and terminate above and in alignment with the slot 117. The parallel arms 124 form a mounting for a direction-changing idler 125 for spaced toothed belts 126 having teeth 127** extending outwardly of the idler and belt.

The parallel spaced arms 124 also form a mounting for a take-up idler 129 engaging the teeth of the toothed belts 126 and taking up tension on said belts to provide a pressure nip through which the paper unrolled from the roll 29 passes to and partially around the idler 125, which positions the paper to extend downwardly through the slot 117. The opposite ends of the arms 124 form a mounting for a direction-changing idler 130 for the toothed belts 126.

Thus, as the paper is trained between the idler 129 and toothed belts 126 downwardly through the dispensing opening 117 and is pulled on by the user of the toweling, the paper toweling will drive the toothed belts 126 and idlers 125 and 130.

The arms 124 of the bracket 39*a* each have an arm 131 extending downwardly therefrom generally parallel to the front wall of the cabinet and past the return opening 123 for the return of paper toweling through said return opening to the spent towel compartment 47.

The direction-changing idler 130 also has spaced toothed belts 132 spaced outwardly of the toothed belts 126 and driven from the idler 130, and with the idler 130 driving the toothed belts 132 to draw spent toweling into the cabinet. The toothed belts 132, like the toothed belts 126, have the teeth thereof extending ouwardly of the rolls 130 and 133, as is clearly shown in FIGS. 10 and 13. The toothed belts 132 are trained about a direction-changing idler 133 rotatably carried by the arms 131, extending downwardly along and past the return opening 123. A take-up idler 135 is mounted between the depending arms 131 of the bracket 39*a* for free rotation with respect thereto and engages the teeth of said toothed belts 132 to provide a pressure nip through which the spent toweling is trained and passed to the bottom of the spent towel compartment 47 of the cabinet 10.

Suitable take-up means may be provided for the take-up idlers 129 and 135 to take up on the respective belts 126 and 132 and provide the required pressure nips with said belts to drive the belts 126 and roll 130 as paper toweling is pulled from the cabinet through the dispensing opening 117 and to drive the toothed belts 132 for returning spent toweling to the bottom of the spent towel compartment of the cabinet. Suitable spacer means may be provided on the rolls 125, 130 and 133 to maintain the toothed belts 126 and 132 in proper spaced relation with respect to each other. Said spacer means may be of any conventional form so need not herein be shown or described.

The bracket 39*a* is mounted on a tie rod 137 extending through the arms 124 of said bracket and connected with the outsides of opposite side walls of the cabinet by acorn nuts 139 threaded on the ends of said tie rods on the outsides of the side walls 13. A second tie rod 140 is provided to connect the lower ends of the arms 131 of the angle bracket 39*a* between the side walls 13 of the spent towel compartment of the cabinet. Acorn nuts 141 are threaded on opposite ends of said tie rod and, like the nuts 139, serve to aid in retaining the bracket 39*a* in position in the cabinet. Limited play may be provided between the rod 140 and arms 131.

Thus, as paper toweling is drawn from the roll 29 in the clean towel compartment, the used toweling is returned to the spent towel compartment by the tension idler 135 and toothed belts 132 driven from the toothed belts 126.

Figure 12:
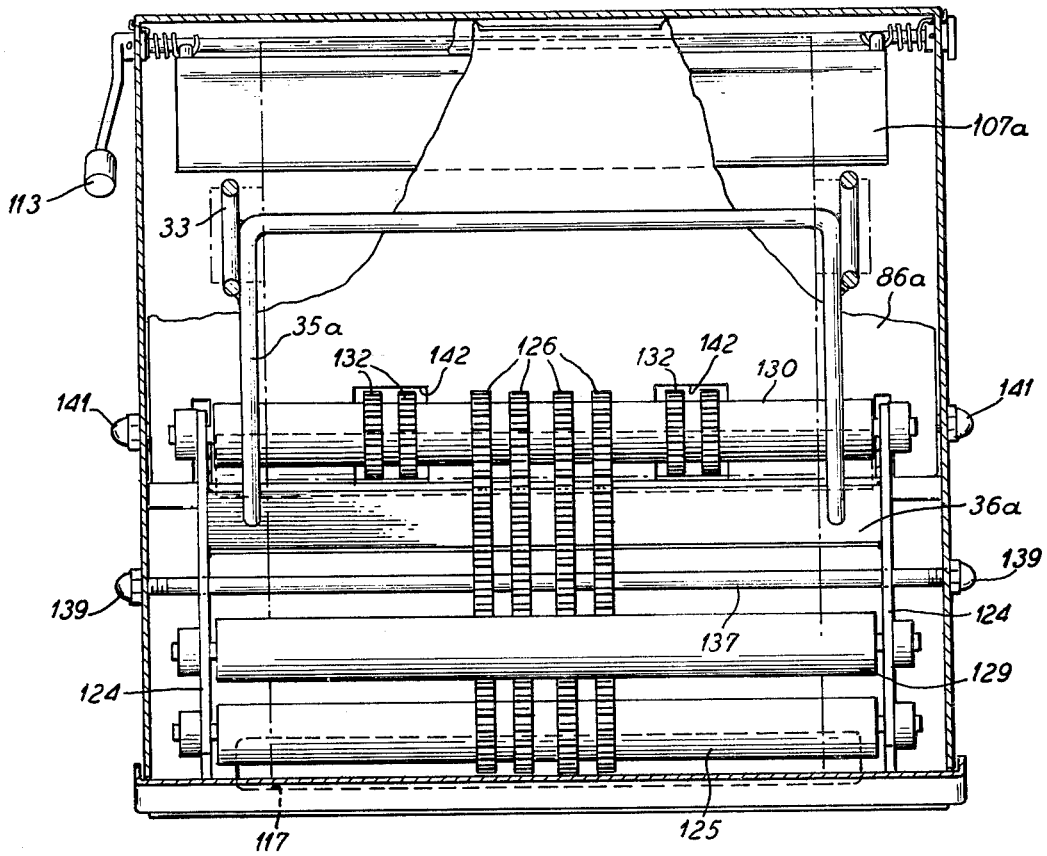
FIG. 12 is a sectional view taken substantially along line XII—XII of FIG. 10.
Figure 13:
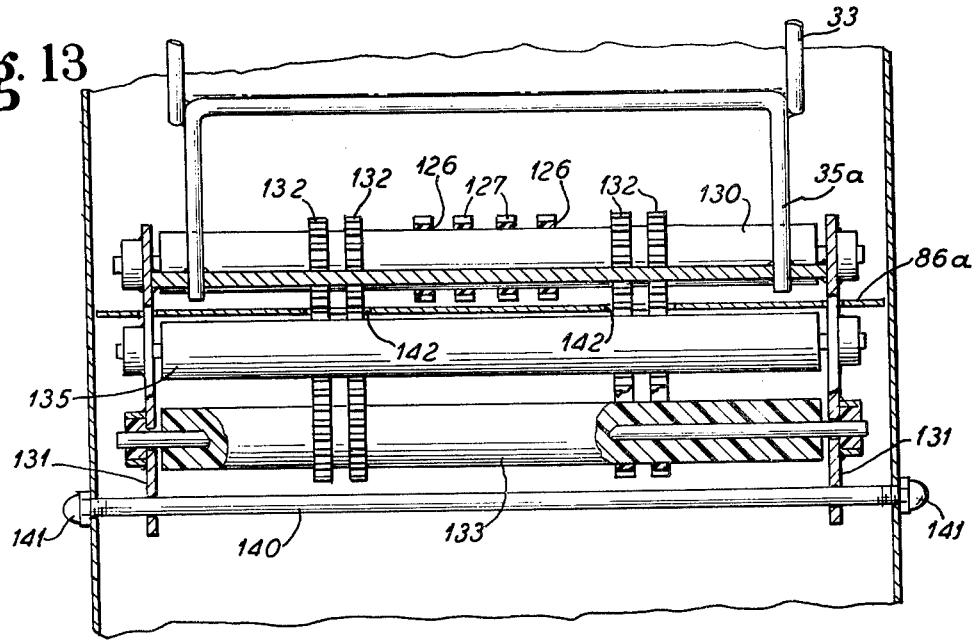
FIG. 13 is a sectional view taken substantially along line XIII—XIII of FIG. 12.

The isolating plate 86*a* may be slotted to accommodate the depending arms 131 of the bracket 39*a* and the toothed belts 132 to pass thereby. The slots are generally shown in FIGS. 12 and 13, and are designated by reference numeral 142.

It should further be understood that the direction-changing rolls 125, 130 and 133 are journalled at their opposite ends in the bracket 39*a* in much the same manner as the rolls 41 and 45. This structure is shown in FIGS. 11 and 12. The rolls themselves are further shown as resilient rolls to provide good gripping surfaces for the belts 126 and 132 and therefore provide a positive drive of the belts 132 from the belts 126.

The foregoing illustrates that the form of the invention illustrated in FIGS. 10 through 13 operates on principles similar to the form of the invention illustrated in FIGS. 1 through 9 and that in both forms of the invention, the spent paper toweling is returned to the cabinet by pressure nips in which pressure exerting tension idlers returning the spent toweling to the cabinet are driven by the withdrawal of toweling from the cabinet.

I claim as my invention:

1. A dispenser for paper toweling of a type difficult to tear, comprising:

a cabinet having an upper clean towel compartment and a lower spent towel compartment, a roll of paper toweling in said clean towel compartment, means removably supporting said roll of paper toweling in said clean towel compartment adjacent the top thereof, towel supply means in said clean towel compartment, a downwardly opening dispensing passageway from said clean towel compartment disposed beneath said towel supply means, means isolating said clean towel compartment from said spent towel compartment, a slot leading into said spent towel compartment to accommodate the return of spent toweling thereinto, towel return means in said spent towel compartment, returning the spent toweling as the clean toweling is withdrawn from said clean towel compartment, drive means driven from said towel supply means for driving said towel return means, said means removably supporting said roll of paper toweling in said clean towel compartment comprising a pair of spaced upwardly opening yokes spaced apart a distance slightly greater than the width of the toweling, means connecting said yokes together at their lower ends, the roll of paper toweling having a tube extending along the interior portion thereof about which the paper toweling is wound, and plugs slidably guided in said yokes and extending within opposite ends of said tube and having positive connection therewith to accommodate clean toweling to be retained for rotation within said clean towel compartment and to be drawn from said clean towel compartment.

2. The dispenser of claim 1 in which a plastic sleeve extends within said first mentioned sleeve and has embossments extending outwardly therefrom having engagement with said paperboard sleeve and has key slots opening to each end thereof, a plug extends within each end of said plastic sleeve, and keying means are provided on each of said plugs to positively engage said keyway slots in said plastic sleeve.

3. The dispenser of claim 1 in which the towel supply means comprises a first pair of pinch rolls and the towel return means comprises a second pair of pinch rolls.

4. The dispenser of claim 3 in which a flexible drive connection is provided from said first pinch rolls to said second pinch rolls, and tension means is provided to maintain pressure nips between said pinch rolls of each set of rolls.

5. The dispenser of claim 7 in which the tension means comprises a set of tensioning springs at opposite ends of the uppermost roll of said first pair of rolls and the lowermost roll of said second pair of rolls, each tensioning spring being common to a first and second pinch roll.

6. The dispenser of claim 1 in which a compactor operable from the outside of said cabinet is provided in said spent towel compartment to compact the spent toweling in the bottom of said compartment and the compactor includes a compactor lever pivoted within said spent towel compartment, and a resilient finger extending for substantially the width of said spent towel compartment and angularly outwardly and downwardly from the top of said compactor lever when in an uppermost position, and lever means operable from the outside of said spent towel compartment for manually pivoting said compactor lever and resilient finger to operate said compactor to compact the spent towel in the bottom of said spent towel compartment.

7. In a paper towel dispenser, a cabinet having an upper clean towel compartment and a lower spent towel compartment, means supporting a roll of clean paper toweling in said clean towel compartment, an opening from said clean towel compartment to accommodate withdrawal of the clean toweling from said compartment at various angles without damaging the towel, a slot into said spent towel compartment, a first pair of pinch rolls having a pressure nip between which the clean paper toweling passes and driven by the paper as pulled through said dispensing opening, a second pair of pinch rolls having a pressure nip between which the spent paper toweling passes and drawing the spent paper toweling in said spent towel compartment, a flexible drive connection between said pinch rolls for driving said second pair of pinch rolls from said first pair of pinch rolls, tensioning means connected between said first and second pairs of pinch rolls to provide pressure nips between each of said pairs of rolls, a partition isolating said clean towel compartment from said spent towel compartment, the opening from said clean towel compartment opening in a downward direction and having smooth edges and being narrower than the width of paper toweling to restrict the width of the paper toweling as drawn between the uppermost of said pinch rolls and permit the clean paper toweling to be pulled in an upward, downward or sidewise direction without tearing.

8. The dispenser of claim 7 in which the lower of said first pinch rolls has a relatively hard resilient exterior portion having a flexible covering extending therealong having a smooth external surface, the upper of the uppermost of said pinch rolls has a transverse center in alignment with the transverse center of the lower of said uppermost pinch rolls and is shorter than the lower of said uppermost pinch rolls and of a length less than the width of the roll of paper toweling, to accommodate the paper toweling to be pulled from said roll of toweling through said outlet passageway in either an upward, downward or sideways direction by users of different heights and in positions at either side of said dispenser, without tearing the paper.

9. In a paper towel dispenser, a cabinet having an upper clean towel compartment and a lower spent towel compartment, means rotatably supporting a roll of clean paper toweling in said clean towel compartment, an access opening from the top of said clean towel compartment to accommodate replacement of the paper toweling as used, a dispensing slot leading from said clean towel compartment, a return slot opening into said spent towel compartment, towel supply means in said clean towel compartment having an endless belt extending along said dispensing slot and a take-up roll providing a pressure nip with said belt sufficient to drive said belt by withdrawal of the paper toweling from said roll, towel return means in said spent towel compartment comprising an endless belt, and a take-up roll providing a pressure nip with said belt sufficient to return spent toweling into said spent towel compartment, when inserted through said return slot between said take-up roll and said last-mentioned endless belt, said first-mentioned endless belt driving said second-mentioned endless belt by the withdrawal of clean toweling through said dispensing slot, and thereby returning the spent paper toweling to said spent towel compartment as the clean toweling is used.

10. The paper towel dispenser of claim 9 in which the first and second belts are parallel spaced belts and the first belts turn about a direction-changing idler adjacent said towel dispensing slot, the second belts turn about a direction-changing idler common to said first and second belts and serve as a drive means for said second belts.

11. The paper towel dispenser of claim 10 in which the belts are toothed belts with the teeth extending outwardly of the direction-changing idlers and the tension idlers engage the teeth of said belts.

12. The paper towel dispenser of claim 11 including a compactor compacting spent paper toweling in the bottom of said spent towel compartment, an isolating plate separating said compartments, a common bracket for first and second belts and forming a support for the clean paper toweling, said bracket, belts and means supporting the clean toweling being removable as a unit.

* * * * *